US006972386B1

(12) United States Patent
McSwiggen

(10) Patent No.: US 6,972,386 B1
(45) Date of Patent: Dec. 6, 2005

(54) DIGITAL PULSE GENERATOR AND MANUFACTURING METHOD THEREOF

(75) Inventor: John P. McSwiggen, Bloomingdale, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 10/895,152

(22) Filed: Jul. 20, 2004

(51) Int. Cl.[7] ..... H01H 9/30
(52) U.S. Cl. ..... 200/11 R; 200/564; 200/570; 200/336
(58) Field of Search ..... 200/11 R, 11 DA, 200/11 TW, 564, 570, 336

(56) References Cited

U.S. PATENT DOCUMENTS

| | | | | |
|---|---|---|---|---|
| 3,165,732 A | | 1/1965 | Kolsterman | |
| 3,621,162 A | | 11/1971 | Wall | |
| 3,812,308 A | | 5/1974 | Bell et al. | |
| 4,455,458 A | | 6/1984 | Oyama | |
| 5,153,391 A | * | 10/1992 | Dzung et al. | 200/11 R |
| 5,194,704 A | | 3/1993 | Michalski et al. | |
| 5,463,692 A | | 10/1995 | Fackler | |
| 6,175,091 B1 | * | 1/2001 | Nishimura et al. | 200/571 |
| 6,448,523 B1 | * | 9/2002 | Aizawa | 200/564 |
| 6,828,517 B2 | * | 12/2004 | Calkin et al. | 200/11 DA |
| 2003/0094353 A1 | | 5/2003 | Ravnkilde et al. | |

FOREIGN PATENT DOCUMENTS

| | | |
|---|---|---|
| DE | 31 36 598 A1 | 3/1983 |
| JP | 59197535 | 9/1984 |
| WO | WO 95/12207 | 5/1995 |

OTHER PUBLICATIONS

International Search Report for Application No. PCT/US04/023846 dated Mar. 23, 2005.

* cited by examiner

*Primary Examiner*—K. Lee
(74) *Attorney, Agent, or Firm*—Marshall, Gerstein & Borun LLP

(57) ABSTRACT

A digital pulse generator including a circular housing having a cover and a base. The base including at least one contact terminal secured therein. The digital pulse generator further including an encoder disc secured within the cover and rotatable relative to the base. The encoder including a plurality of projections formed on a first side of the encoder disc such that each of the plurality of projections defining a ridge and a valley. A ball positioned adjacent to the first side of the encoder and adapted to roll between the ridge and the valley. The ball coupled to a flexible contact and adapted to alternately engage the at least one terminal contact when the ball is adjacent to the ridge.

20 Claims, 7 Drawing Sheets

DIGITAL PULSE GENERATOR AND MANUFACTURING METHOD THEREOF

TECHNICAL FIELD

This patent generally relates to switches, and more particularly, to digital pulse generators used in communication devices, audio devices, listening devices, such as hearing aids, or the like.

BACKGROUND

To date, there have been proposed a wide variety of conventional digital pulse generators for various audio devices. With the continual advances in the performance of the devices, ever-increasing demands are placed upon improving the performance, fabrication, and miniaturization of the communication devices, audio devices, and listening devices such as hearing aids. As the size of the listening and communication devices decreases, the utility of conventional digital pulse generators likewise decrease for use in these devices.

In order to meet the needs of smaller devices with limited space available to accommodate the digital pulse generators, the size of the components of the generators have also become smaller. Apart from the pursuit of miniaturization, there is a need to minimize the components so as to provide a cost effective, easily assembled product.

BRIEF DESCRIPTION OF THE DRAWINGS

For a more complete understanding of the invention, reference should be made to the following exemplary embodiments disclosed in the following detailed description and accompanying drawings wherein.

DETAILED DESCRIPTION

Figure 1:
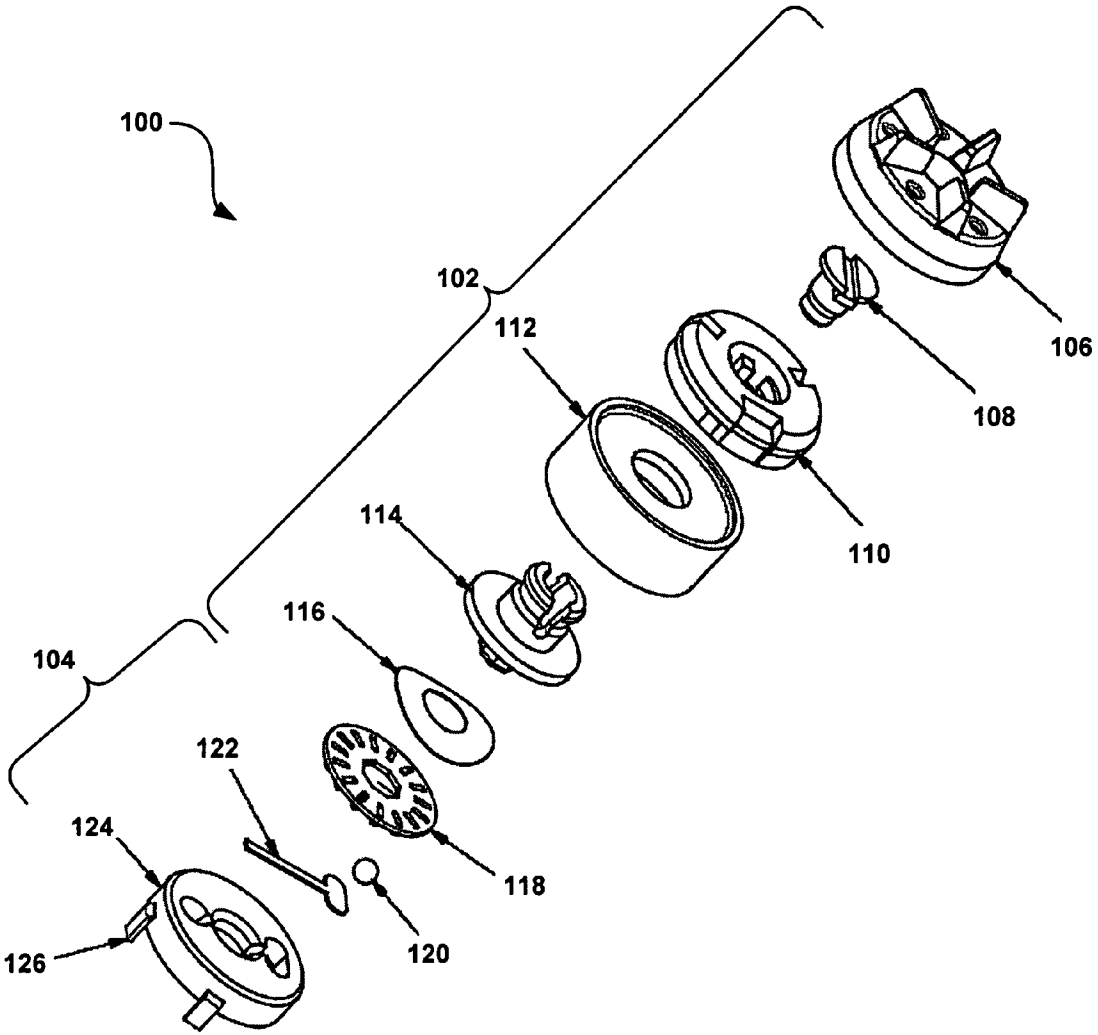
FIG. 1 is an exploded view illustrating a digital pulse generator embodying the teachings of the present disclosure.

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

It should also be understood that, unless a term is expressly defined in this patent using the sentence "As used herein, the term '__' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Unless a claim element is defined by reciting the word "means" and a function without the recital of any structure, it is not intended that the scope of any claim element be interpreted based on the application of 35 U.S.C. §112, sixth paragraph.

FIG. 1 illustrates an exploded view of an exemplary digital pulse generator 100 that can be used in virtually any type of communication devices, such as audio devices, listening devices and/or hearing aids, cellular telephones, web-enabled cellular telephones, Personal Digital Assistants (PDAs), hand-held computers, laptops, and other devices capable of communication over public or private communication networks. There are several different hearing aid styles widely known in the hearing aid industry: Behind-The-Ear (BTE), In-The-Ear or All-In-The-Ear (ITE), In-The-Canal (ITC), and Completely-In-The-Canal (CIC).

The digital pulse generator 100 produces a digital pulse signal and includes a rotatable portion 102 and a base portion 104. The rotatable portion 102 may include a user operable member such as a knob 106, a plug 108, a knob base 110, a housing 112, a rotor 114, a spring disc 116, and an encoder disc 118. The encoder disc 118 and the spring disc 116 are held in contact with the rotor 114, when these components are positioned within the housing 112. The knob base 110 is secured between the knob 106 and the rotor 114 and housing 112 by the plug 108 which, in turn, engages the rotor 114. The knob 106, as illustrated, fixedly attaches to the knob base 110 by a snap-on engagement system. However it will be understood that the knob 106 and the knob base 110 may be joined together by mechanical fastening, crimping, welding, adhesive bonding or any other suitable attachment arrangement.

The base portion 104 includes a movable member such as a movable ball 120, a contact member 122, a base member 124, and a plurality of terminals 126. The ball 120, which may be a cylindrical roller, is compressively held in contact with the contact member 122 disposed within the base member 124. The contact member 122 communicatively connects to the plurality of terminals 126 fixedly attached around the circumference of the base member 124, as illustrated in the exemplary embodiment shown in FIG. 1. Thus, when the components included in the rotatable portion 102 and the base portion 104 are secured or placed in a final or closed position, the knob 106 is mechanically connected with the terminals 126.

Figure 2:
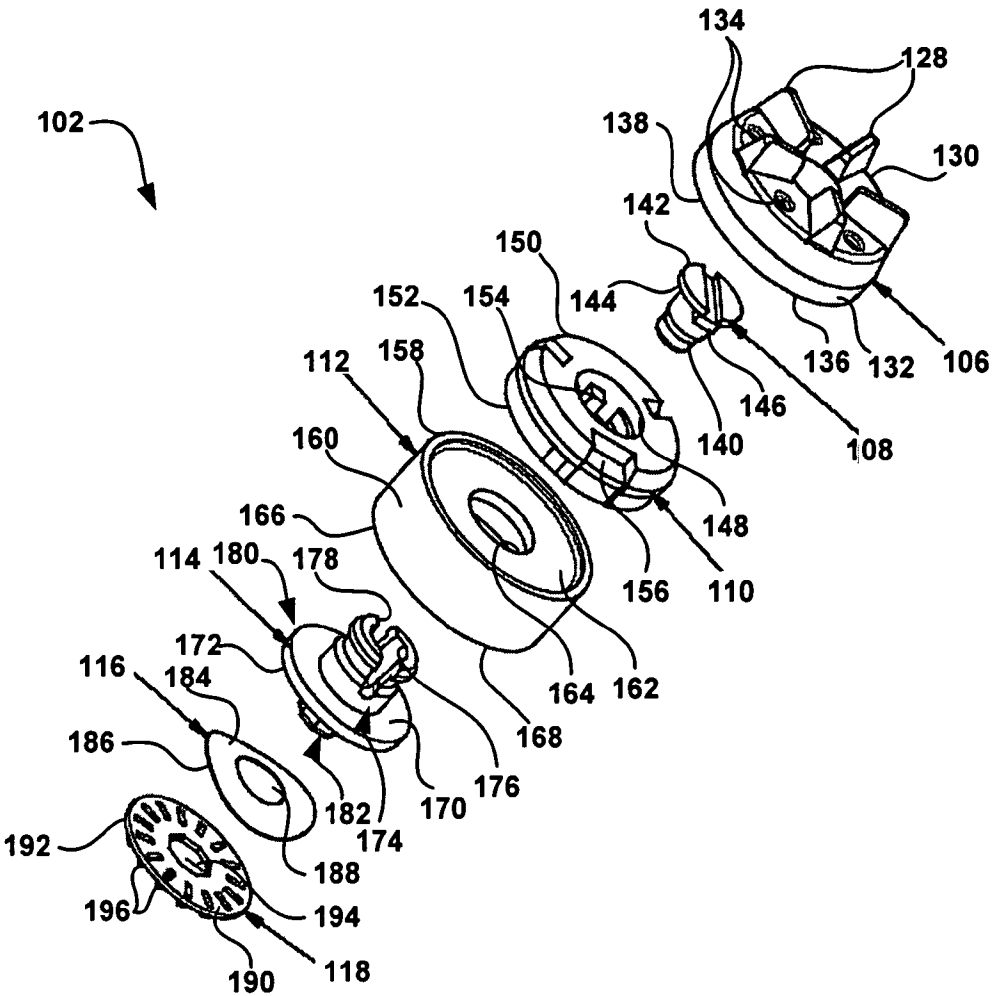
FIG. 2 is an enlarged exploded view illustrating a rotatable portion of a digital pulse generator shown in FIG. 1.

FIG. 2 illustrates an enlarged exploded view of the rotatable portion 102 illustrated in FIG. 1. The knob 106 defines a substantially cylindrical shape and includes a top portion 130 and a bottom portion 132. In alternate embodiments, the knob 106 may take the form of various shapes and have a number of different sizes based on the intended application, operation conditions, required components, etc. The knob 106 will typically be manufactured from an electrically insulating material such as a molded thermoplastic material, but it will be understood that the knob 106 may be coated or otherwise treated to impart the desired insulating properties.

A plurality of upwardly extending flanges 128 may be punched out and attached to or molded onto the top portion 130 to facilitate the rotation of the knob 106. A plurality of apertures 134 are introduced on the top portion 130 of the knob 106. An opening 138 defined at the bottom portion 132 of the knob 106 is adapted to receive the knob base 110. A plurality of guide blocks 136 are provided adjacent to the bottom portion 132 of the knob 106. The guide blocks 136 may be fixedly attached to the knob base 110 by, for example, a snap-on engagement system. However, it will be understood that any known joining method such as, for example, mechanical fastening, crimping, welding or adhesive bonding, would suffice.

The rotatable portion 102 may further cooperate with the plug 108 which includes a guide shaft 140. The exemplary plug 108 has a first surface 142 and a second surface 144 and is designed to engage the knob base 110, the housing 112, and the rotor 114. In particular, the second surface 144 of the plug 108 includes a guide block member 146 sized to engage the complimentary feature formed within the rotor 114. The knob base 110 is typically formed with a hollow section 148, and first and second surfaces 150 and 152 adapted to orient and align the base during assembly.

An annular projection 154 may be punched out and attached to or molded into the inner peripheral portion of the hollow section 148 formed in the knob base 110 to engage and align a complimentary feature of the knob 108. The knob base 110 may further include a plurality of recess members 156 formed on the outer surface of the knob base 110 and adapted to engage the guide blocks 136 formed adjacent to the bottom portion 132 of the knob 106. The recess members 156 and the guide blocks 136 may be joined by a snap-on engagement mechanism for securely engaging the knob 106 with the knob base 110. However, it will be understood that any form of joining will suffice such as mechanical fastening, crimping, welding or adhesive bonding.

The shape of the knob base 110 generally corresponds to the knob 106 and the housing 112, but may take the form of the various shapes and sizes in different embodiments. The knob base 110 is fabricated from an electrically insulating material such as a molded thermoplastic material, but it will be understood that the knob base 110 may be coated or otherwise treated to impart the desired insulating properties.

The generally cylindrical housing 112 includes an upper surface 158 and a side wall portion 160. In alternate embodiments, the housing 112 may take the form of various shapes and have a number of different sizes. A generally annular member 162 may be punched out and attached to or molded into the inner peripheral portion of the housing 112. An aperture 164 may be formed or manufactured within the annular member 162 and sized to receive the rotor 114. The aperture 164 may be formed in any suitable manner such as drilling, punching, or molding. The side wall portion 160 of the housing 112 includes a connecting surface 166, distal to the upper surface 158, defining an opening 168. The connecting surface 166 may be sized to receive the base member 124 (see FIG. 1) which, in turn, provides a closure or sealing portion for the other components in the housing 112. The housing 112 is fabricated from an electrically insulating material such as a molded thermoplastic material, but it will be understood that the housing 112 may be coated or otherwise treated to impart the desired insulating properties.

The rotor 114 may include a disc-shaped spacer 180 having a first surface 170 and a second surface 172, a pair of semi-cylindrical elongated prongs 174 formed on the first surface 170, and a mounting post 182 formed on the second surface 172. The exemplary prongs 174 include a hollow section 176 and a lateral slot 178 adapted to receive the guide shaft 140 of the plug 108. When assembled, the guide shaft 140 extends through the hollow section 148, the aperture 164 and into the hollow section 176 such that the plug 108, the knob base 110, and the rotor 114 cooperate to define a rotatable structure. The prongs 174, in turn, engage the annular projection. 154 to prevent unintended removal of the rotor 114 from the knob base 110. The rotor 114 is fabricated from an electrically insulating material such as a molded thermoplastic material, but it will be understood that the rotor 114 may be coated or otherwise treated to impart the desired insulating properties.

As previously discussed, the mounting post 182 is integrally formed on the second surface 172 of the spacer 180. In order to facilitate securing of the encoder disc 118 and the spring disc 116 to the knob 106, the mounting post 182 may be sized and/or shaped to pass through a bore 194 formed within the encoder disc 118.

The rotatable portion 102 may further include the spring disc 116 having a hollow section 188 and first and second surfaces, 184 and 186, respectively, for providing biasing the movable ball 120 into contact with the encoder disc 118. The exemplary spring disc 116 is shown to have at least one layer, but may be fabricated from alternating layers of various materials. Typically, the exemplary spring disc 116 is fabricated from any resiliently deformable material such as, for example, brass, steel or an elastomer.

The spring disc 116 may have various shapes and sizes that do not necessarily correspond to the shape and size of the housing 112. In one embodiment, the spring disc 116 has a generally circular shape that corresponds to the overall shape of the housing 112. The thickness and material of the spring disc 116 may vary depending on the requirements of the application. When assembled, the first surface 184 is held in contact with the second surface 172 of the rotor 114, and the mounting post 182 extends through the hollow section 188 in the spring disc 116.

The exemplary circular encoder disc 118 includes a first surface 190 and a second surface 192. The encoder disc 118 may be formed in various shapes and sizes that do not directly correspond to the shape of the housing 112 based on the intended applications, operating conditions, and required components. The bore 194 is sized and shaped to engage the mounting post 182 of the rotor 114, thereby enabling the encoder disc 118 to be securely mounted adjacent to the second surface 172 of the rotor 114.

A plurality of projection members 196 such as, for example, projections having a triangular or rounded cross-section, may be formed on the second surface 192 of the encoder disc 118 to facilitate the intermittent contact with the contact member 122 (see FIG. 1) by deflecting away from the movable ball 120 which will be described in greater details. The encoder disc 118 may be made of stainless steel (UNS S30200), carbon steel (AISI 1018), strengthened and hardened 17-7pH alloy (UNS S17700), Acetal homopolymer, commonly available under the trade designation DELRIN® from E.I. du Pont de Nemours and Company (DuPont), or of any similar materials.

Figure 3:
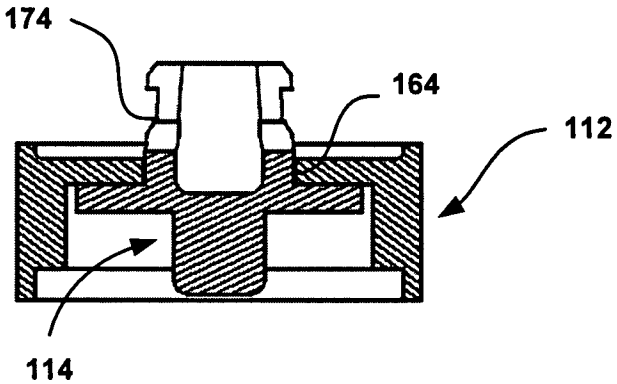
FIGS. 3–7 are cross-sectional views of the rotatable portion of the digital pulse generator shown in FIG. 2.
Figure 5:
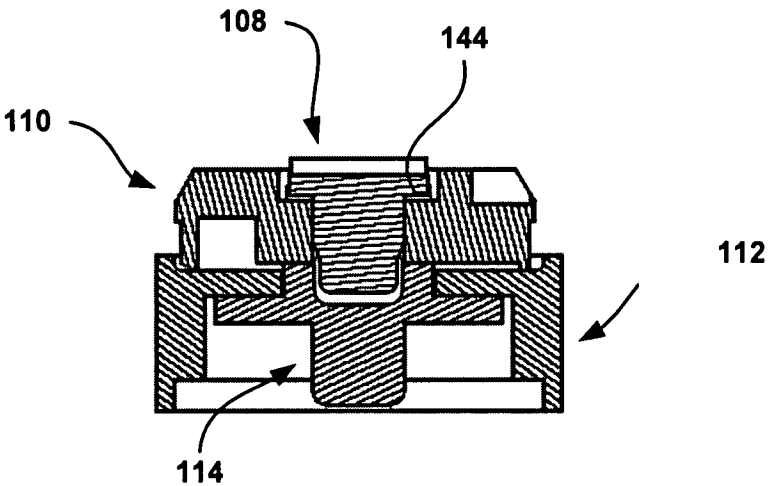
Figure 4:
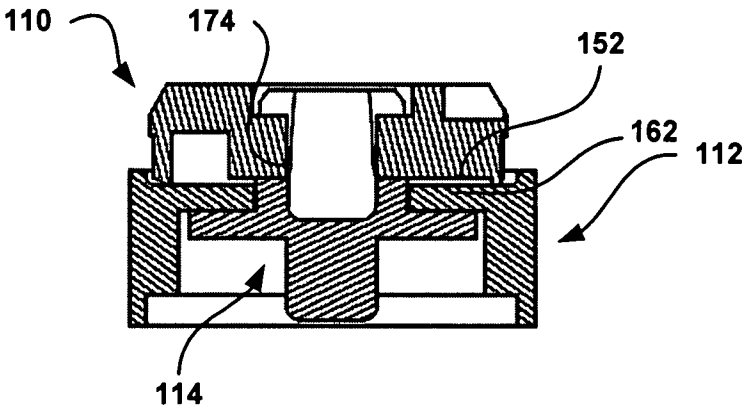
Figure 7:
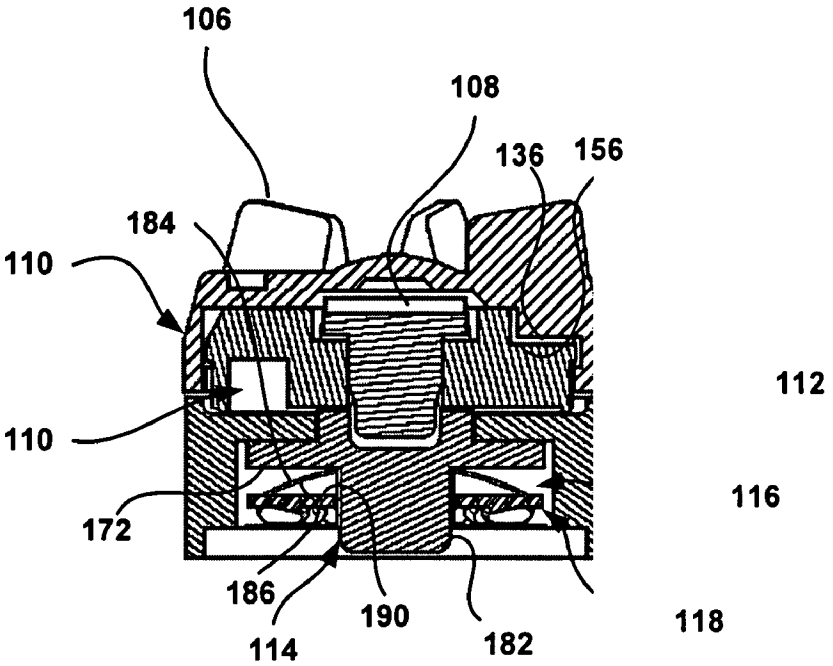
Figure 6:
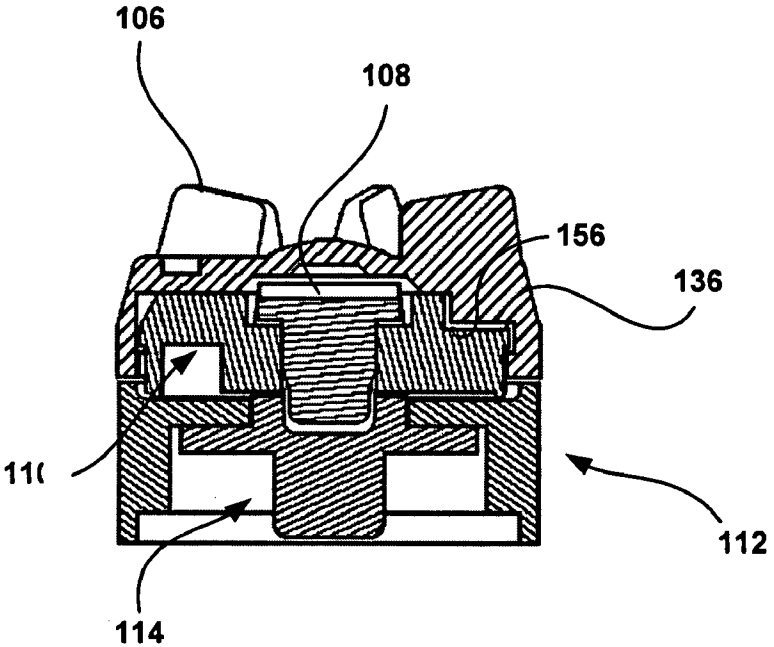

FIGS. 3–7 illustrate cross-sectional views that will be referred to in conjunction with an exemplary method of assembling the rotatable portion 102 of the digital pulse generator 100. FIG. 3 shows the rotor 114 inserted in the housing 112 with the prongs 174 extended through the aperture 164 of the housing 112. FIG. 4 shows the knob base 110 positioned adjacent to the housing 112 with the second surface 152 of the knob base 110 facing and engaging the planar annular member 162 of the housing 112. The annular projection 154 (see FIG. 2) of the knob base 110 aligns and adheres with the prongs 174 of the rotor 114 to prevent removal of the rotor 114 from the knob base 110. FIG. 5 shows the second surface 144 of the plug 108 held in contact with the inner peripheral portion of the knob base 110. The guide block member 146 (see FIG. 2) of the plug 108 aligns and adheres within the hollow section 176 of the prongs 174. FIG. 6 shows the guide blocks 136 of the knob 106 fixedly engaging the recess members 156 of the knob base 110 by a snap-on engagement. Thus, the knob 106 is securely affixed to the housing 112. FIG. 7 shows the first surface 184 of the spring disc 116 oriented towards the second surface 172 of the rotor 114 when inserted into the housing 112. The encoder disc 118 engages the housing 112 such that the first surface 190 of encoder disc 118 faces the second surface 186 of the spring disc 116. In particular, the mounting post 182 of the rotor 114 aligns and secures the spring disc 116 and the encoder disc 118 to the knob 106 to cooperatively create a system for producing intermittent movement. Formed in this manner, the digital pulse generator 100 has the advantage of reduced electrical path between the rotatable portion 102 and the base portion 104, thereby decreasing the complexity of the generator 100. A device built in accordance with the inventive concepts disclosed herein has the advantage of reduced overall size and reduced part count.

Figure 8:
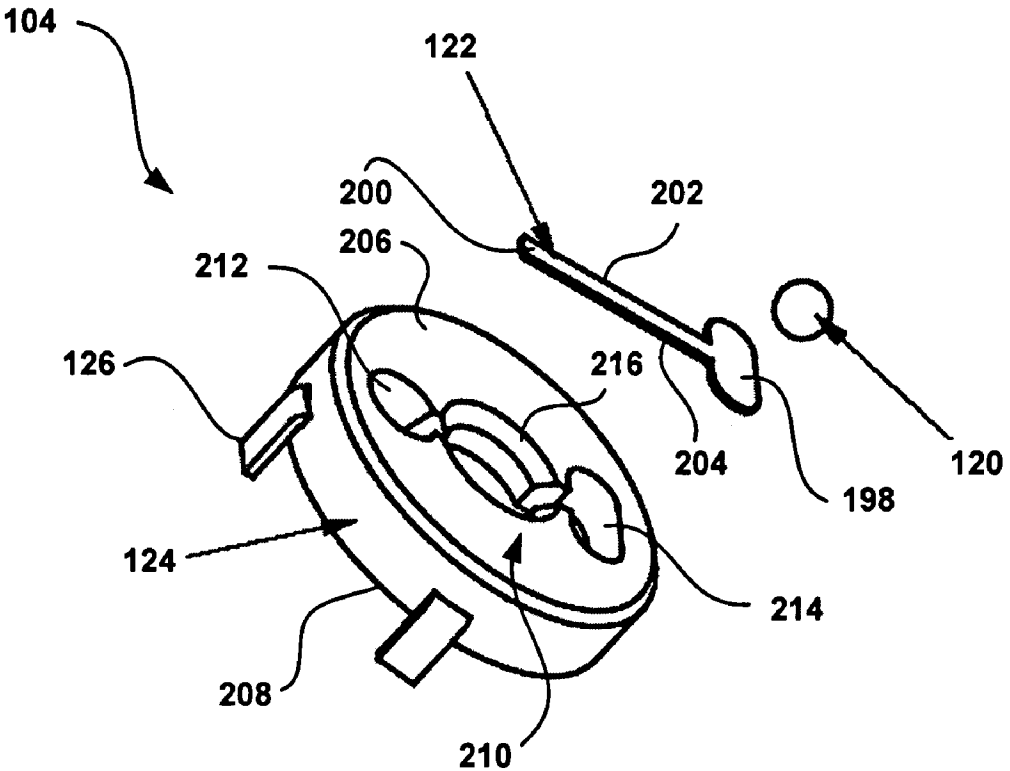
FIG. 8 is an enlarged exploded view of a base portion of the digital pulse generator shown in FIG. 1.

FIG. 8 illustrates an enlarged exploded view of a base portion 104 shown in FIG. 1. The exemplary movable ball 120 is shown as a substantially spherical ball adapted to be held in contact with the contact member 122 and the projection members 196 of the encoder disc 118. The movable ball 120 can be manufactured from a variety of materials such as, for example Corundum (Al2O3), conductive materials, non-conductive materials, or any other similar materials. When assembled, the movable ball 120 is disposed between the second surface 192 of the encoder disc 118 and the contact member 122.

The contact member 122 maybe generally T-shaped and include a flap portion 198 and a leg portion 200. In one embodiment, the flap portion 198 is shorter in length than and twice as wide as the leg portion 200. The flap portion 198 and the leg portion 200 are integrally formed from a blank (not shown). The contact member 122 may be fabricated of electrically conductive, corrosion resistant material such as, for example, a precious metal alloy. For example, the contact member 122 may be an age-hardenable palladium silver-based alloy, commonly available under the trade designation Paliney 6 or Paliney 7, a Beryllium-Copper alloy (BeCu), or of any similar materials. The contact member 122 has a first surface 202 and a second surface 204. The first surface 202 of the flap portion 198 is held in contact with the ball 120 under the influence of the encoder disc 118.

The base portion 104 including the base member 124 may have a guide pocket 210 formed in a substantially circular shape to correspond to the housing 112. The base member includes first and second surfaces 206, 208, respectively. In alternate embodiments, the base member 124 may take the form of various shapes and have a number of different sizes based on the intended applications, operation conditions, required components, etc.

The guide pocket 210 formed on the first surface 206 may be adapted to receive the contact member 122. A first pocket 212, a second pocket 214, and a connecting pocket 216 collectively constitute the guide pocket 210 and are sized to receive the contact member 122 and the ball 120. The second pocket 214 is typically sized and shaped to receive the flap portion 198 of the contact member 122. Further, the second pocket 214 is adapted to receive and hold the ball 120 to thereby provide electrical contact via the contact member 122.

In operation, movement of the knob base 110 causes the rotor 114 to rotate therewith which, in turn, rotates the encoder disc 118 compressibly secured with the spring disc 116. The projection member 196 of the encoder disc 118 rotatably engage the ball 120 causing the ball 120 to slide freely, within the second pocket 214, from one end of the flap portion 198 to the other end of the flap portion 198 of the contact member 122, or vice versa. Continued rotation of the encoder disc 118 and the projection members 196 pushes the ball 120 into contact with the contact member 122 and the contact member 122 into communication with one of the directional contacts 215 (see FIG. 9). Rotation of the encoder disc 118 shifts the ball 120 between the two contact positions (e.g., the open and closed contact positions) to produce a digital pulse which can, in turn, form an input to a circuit to affect control of a volume or other function. The plurality of terminal 126 is fixedly attached to the base member 124 as shown in FIG. 8.

Figure 11:
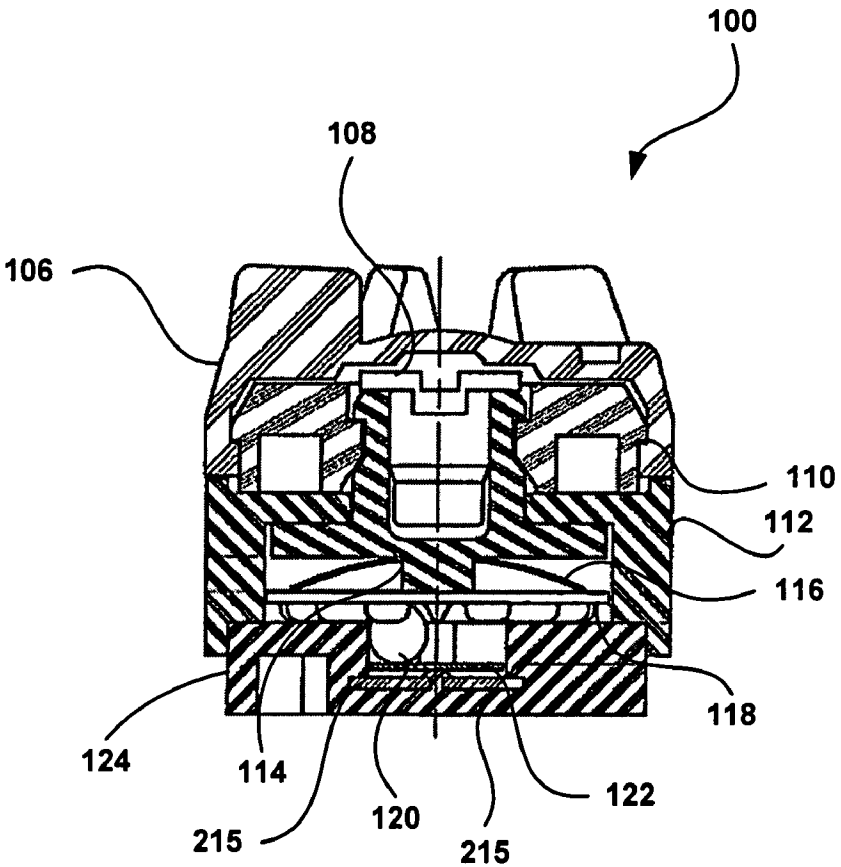
FIG. 11 is a cross-sectional view of the digital pulse generator shown in FIG. 1.
Figure 9:
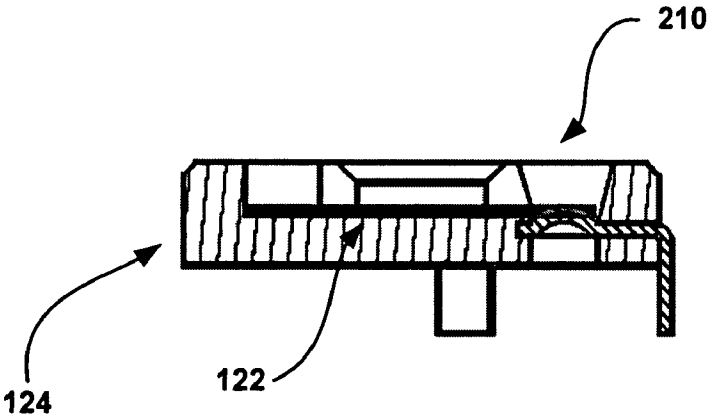
FIGS. 9–10 are cross-sectional views of the base portion of the digital pulse generator shown in FIG. 7.
Figure 10:
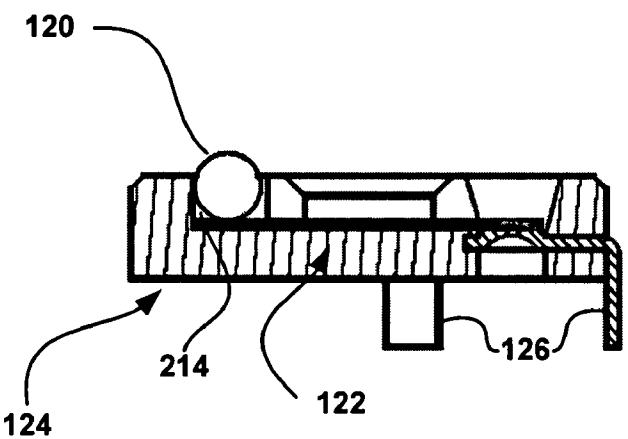

FIGS. 9–11 illustrate cross-sectional views that will be referred to in conjunction with a description of a method of assembling the base portion 104 of the digital pulse generator 100. FIG. 9 illustrates, the contact member 122 positioned within the guide pocket 210 of the base member 124. FIG. 10 illustrates the movable ball 120 biased within the second pocket 214 of the guide pocket 210. FIG. 11 illustrates the rotatable portion 102 and the base portion 104 assembled in a final or closed position, thereby locking the internal components in position. With this arrangement, the spring disc 116, the encoder disc 118, the ball 120, and the contact member 122 collectively constitute a means for causing an intermittent movement. Such an intermittent movement mechanism, disposed between the rotor 114 and the base member 124 allow the ball 120 to facilitate deflection of the flap portion 198 of the contact member 122 between the two contact positions with rotation of the encoder disc 118. It will be understood that the contact member 122 may be a coil spring, tapered spring, O-ring spring or any other deformable spring allowing deflection of the ball 120. Rotation of the encoder disc 118 shifts the ball 120 between the two contact positions (e.g., the open and closed contact positions) to produce a digital pulse which can, in turn, form an input to a circuit to affect control of a volume or other function Formed in this manner, the digital pulse generator 100 has the advantage to further reduced electrical path between the rotatable portion 102 and the base portion 104, thereby decreasing the complexity of the generator 100. A device built in accordance with the inventive concepts disclosed herein has the advantage of reduced overall size and reduced part count.

Figure 12:
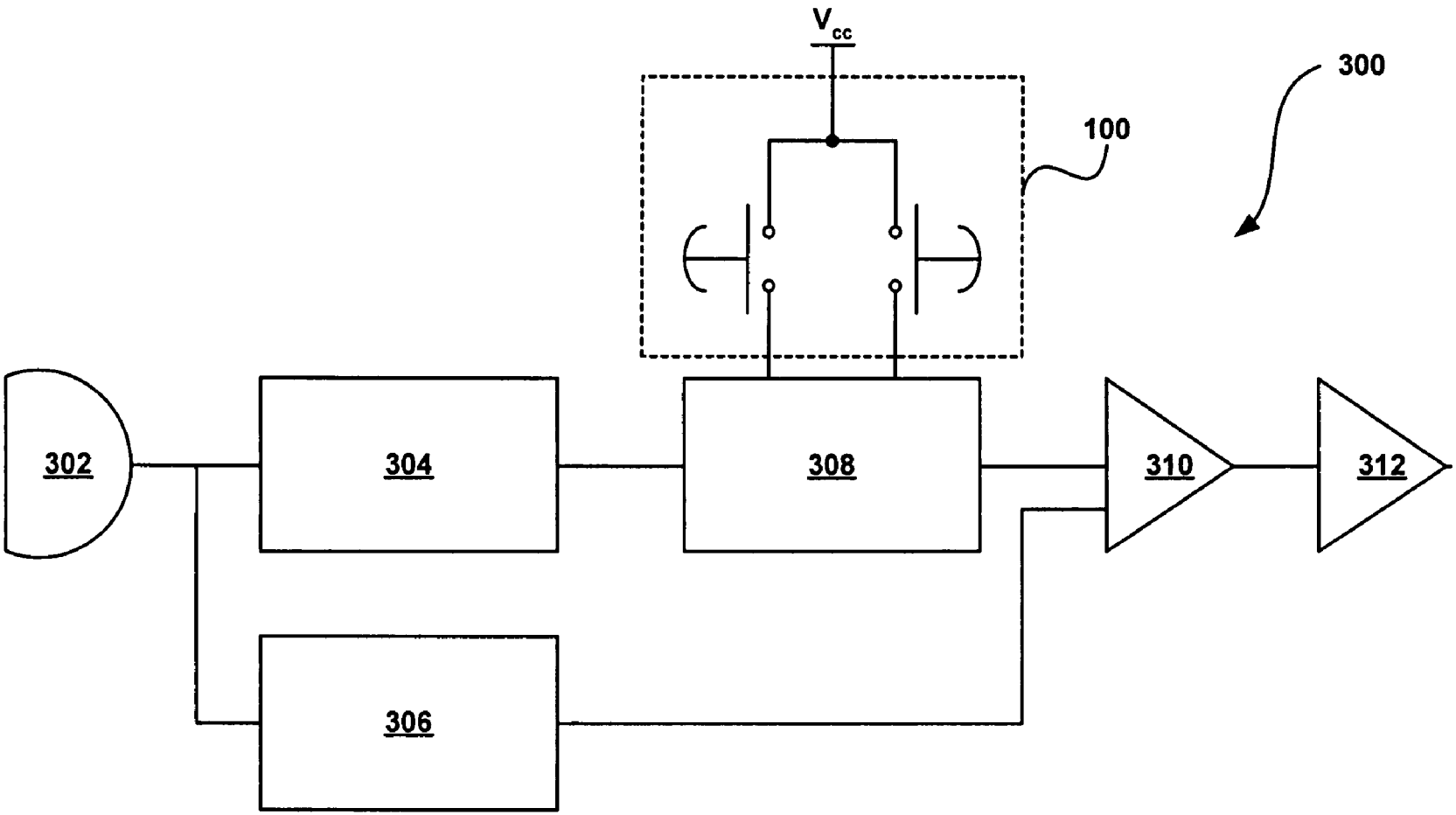
FIG. 12 is a block diagram of a hearing aid system incorporating the exemplary digital pulse generator of the present disclosure.

FIG. 12 illustrates a block diagram of a hearing aid system 300 of the invention. The system 300 includes a microphone 302, a compression amplifier 304, a linear amplifier 306, a digital pulse generator 100, a summer 310, an output amplifier 312, and a receiver 314. The microphone 302 is electrically coupled to the compression amplifier 304. The compression amplifier 304 may receive an input generated by the cooperation of the encoder disc 118, the ball 120 and the contact member 122 to produce a digital signal that is supplied to an electronic volume control 308 as an input signal. As described earlier, the digital pulse generator 100 is designed to produce a digital pulse signal which changes the level of the electronic volume control 308. Rotation of the knob 106 by the user of the hearing aid controls, as generally shown in FIG. 1, adjusts the volume of the hearing aid. Alternatively, the digital pulse generator 100 may be connected to a printed board in the communication devices, audio devices or the like via the terminals for adjusting and controlling the volume. However, the generator 100 may be designed for controlling a plurality of functions/operations of the communication devices, audio devices, listening devices, such as hearing aids, or the like.

All references, including publications, patent applications, and patents, cited herein are hereby incorporated by reference to the same extend as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A digital pulse generator including a housing having a base and at least one electrical contact positioned within the base, the digital pulse generator comprising:

an encoder having a plurality of projections formed on a first side, the encoder secured within the housing;

a roller positioned adjacent to the first side of the encoder and adapted to translate relative to the plurality of projections between a contact position and a non-contact position; and a flexible contact adapted to cooperate with the roller and engage the at least one electrical contact when the roller is translated into the contact position by the plurality of projections.

2. The digital pulse generator of claim 1, further comprising a spring engaged against the second side of the encoder to bias the encoder towards the base.

3. The digital pulse generator of claim 2, wherein the spring is a disc spring.

4. The digital pulse generator of claim 1, wherein the plurality of projections have a substantially triangular cross-section.

5. The digital pulse generator of claim 4, wherein the plurality of projections cooperate to translate the roller in a substantially linear path relative to the base.

6. The digital pulse generator of claim 1, wherein the encoder is an encoder disc.

7. The digital pulse generator of claim 6, wherein the encoder disc material is selected from the group consisting of: stainless steel, carbon steel, a steel alloy, acetal homopolymer.

8. The digital pulse generator of claim 1, wherein the roller is a substantially spherical ball.

9. The digital pulse generator of claim 8, wherein the spherical ball material is selected from the group consisting of: corundum, conductive materials, and non-conductive materials.

10. The digital pulse generator of claim 1, wherein the flexible contact is selected from the group consisting of: a coil spring, a tapered spring, and an O-ring spring.

11. A digital pulse generator comprising:

a circular housing having a cover and a base;

at least one contact terminal secured within the base;

an encoder disc secured within the cover and rotatable relative to the base;

a plurality of projections formed on a first side of the encoder disc, each of the plurality of projections defining a ridge and a valley;

a ball positioned adjacent to the first side of the encoder and adapted to roll between respective ridges and the valleys defined by the plurality of projections; and a flexible contact adapted to cooperate with the ball and alternately engage the at least one terminal contact when the ball is adjacent to the ridge.

12. The digital pulse generator of claim 11, further comprising a spring engaged against a second side of the encoder and adapted to bias the encoder towards the base.

13. The digital pulse generator of claim 12, wherein the spring is a disc spring.

14. The digital pulse generator of claim 11, wherein the flexible contact is selected from the group consisting of: a coil spring, a tapered spring, and an O-ring spring.

15. The digital pulse generator of claim 11, wherein the plurality of projections have a substantially triangular cross-section.

16. The digital pulse generator of claim 15, wherein the plurality of projections cooperate to translate the roller in a substantially linear path relative to the base.

17. The digital pulse generator of claim 11, wherein the flexible contact is a substantially T-shaped contact.

18. The digital pulse generator of claim 11, wherein the flexible contact is formed from a material selected from the group consisting of:

palladium-silver alloy, and beryllium-copper alloy.

19. The digital pulse generator of claim 11, wherein the flexible contact is fixedly attached to a first end, and flexibly coupled to the ball at a second end.

20. The digital pulse generator of claim 11, wherein the cover is a knob adapted to turn the encoder disc.

* * * * *